United States Patent [19]

Sehnert et al.

[11] Patent Number: 4,523,650

[45] Date of Patent: Jun. 18, 1985

[54] EXPLOSIVE SAFE/ARM SYSTEM FOR OIL WELL PERFORATING GUNS

[75] Inventors: Steven D. Sehnert, Houston; Gerald B. McClure, Sugarland; William A. McPhee, Houston, all of Tex.

[73] Assignee: Dresser Industries, Inc., Dallas, Tex.

[21] Appl. No.: 560,677

[22] Filed: Dec. 12, 1983

[51] Int. Cl.[3] ..... E21B 43/116

[52] U.S. Cl. ..... 175/4.56; 102/310

[58] Field of Search ..... 175/4.56, 4, 4.51, 4.53, 175/4.54, 4.6; 166/297-299, 51, 55.3, 63; 102/20, 310, 306; 89/1 C

[56] References Cited

U.S. PATENT DOCUMENTS

| | | | |
|---|---|---|---|
| 2,641,185 | 6/1953 | Lockett | 102/20 |
| 2,655,993 | 1/1948 | Spencer | 164/0.5 |
| 2,883,932 | 3/1959 | Caldwell | 102/20 |
| 2,924,173 | 2/1960 | Robertson | 102/20 |
| 2,925,775 | 2/1960 | McKee | 102/20 |
| 3,052,784 | 9/1962 | Ousley | 200/158 |
| 3,366,179 | 1/1968 | Kinley et al. | 166/55.3 |
| 3,430,568 | 3/1969 | Amster | 102/82 |
| 4,011,815 | 3/1977 | Garcia | 175/4.56 X |
| 4,172,421 | 10/1979 | Regalbuto | 102/20 |
| 4,314,614 | 2/1982 | McPhee et al. | 175/4.56 |
| 4,319,526 | 3/1982 | DerMott | 102/310 |

*Primary Examiner*—George A. Suchfield
*Assistant Examiner*—Thuy M. Bui
*Attorney, Agent, or Firm*—Patrick H. McCollum; Richard M. Byron

[57] ABSTRACT

An explosive safe/arm system for use in a perforating gun includes a selectively rotatable member mounted intermediate a detonator and a length of detonator cord. The rotatable member includes a transversely oriented bore which is selectively rotatable into and out of axial alignment with the detonator and the detonator cord. Mounted within the bore is an explosive element for transferring an explosive detonation wave from the detonator to the detonator cord when the bore is in axial alignment.

11 Claims, 3 Drawing Figures

EXPLOSIVE SAFE/ARM SYSTEM FOR OIL WELL PERFORATING GUNS

BACKGROUND OF THE INVENTION

This invention generally relates to improved systems for safe/arm devices, and more particularly to systems for explosive disarming and arming of oil well perforating instruments.

It is common practice in the completion of oil and gas wells to perforate the well casing and the surrounding formations to bring a well into production by the utilization of detonating explosives of high velocity and of the general character and forms known as "shaped charges", as for example, the type described in U.S. Pat. No. 4,387,773, issued to W. A. McPhee and assigned to the assignee of the present invention.

In the operation of a shaped charge perforating gun, a gun assembled body containing a plurality of shaped charges is lowered into a wellbore. The gun is positioned opposite the subsurface formations to be perforated. Electrical signals are passed typically from a surface location through a wireline to one or more blasting caps located in the gun body thereby causing detonation of the blasting caps. The exploding blasting caps in turn transfer a detonating wave to a detonator cord which further causes the shaped charges to detonate. The detonated shaped charges form a energetic stream of high pressure gasses and high velocity particles, a so called "jet", which perforates the well casing and the adjacent formations.

Due to the explosive and dangerous nature of shaped charge perforating guns, when in storage or shipment the primary explosives, commonly blasting caps, must be segregated from the detonator cord and thus the shaped charges. In the past only by physical segregation could one be assured that the perforating guns would not accidentally fire due to spurious ignition of the blasting cap caused by physical shock or static electricity. Unfortunately such physical segregation results in the necessity of assembling the perforating gun at the wellsite. Due to the adverse conditions of the oil field, the technical complexities involved and the time requirements of such an operation, well site assembly is impractical and dangerous. Several safe/arm devices have found use in shaped charge perforating guns. For example, U.S. Pat. No. 4,314,614, describes a system where an interrupter member is inserted within an air gap between an ignitor section and an explosive charge section of a blasting cap. Although such device allows transportation of a loaded, but safed, perforating gun it requires a special electric blasting cap and cannot easily be re-safed once armed. Another such system is described in U.S. Pat. No. 4,011,815. In this system an explosive booster is releasably retained in a first safe position while being selectively movable along the longitudinal dimension of the gun body to an armed position. It should be recognized that such a system requires extensive and costly modifications to the typical perforating gun and adds additional length to the gun member.

SUMMARY OF THE INVENTION

In a preferred embodiment of the invention, an oil well perforating device is provided which in its overall concept includes a plurality of tubular housing sections joined together to form a perforating gun. Each housing section contains a shaped charge unit, a length of detonator cord and a primary explosive, electrical blasting cap. Intermediate the blasting cap and the detonator cord is rotatably mounted a generally cylindrical member. This cylindrical member has a transversely oriented bore with a pellet of high explosive material retained therein. The cylindrical member is rotatable by means of a special tool inserted through an aperture in the gun body to align the explosive pellet within the path of propagation of the detonating wave propagation from the blasting cap to the detonator cord in the armed position, or out-of-line with the path of detonating wave propagation, in the safe position. When all the sections of the perforating gun are rendered armed it can be lowered into a wellbore for normal perforating operations.

Accordingly, it is a feature of the present invention to provide a system for selectively disarming and arming explosive oil well perforators.

It is another feature of the present invention to provide a system to prevent uncontrolled ignition of shaped charges within a perforating gun.

It is yet another feature of the present invention to provide a system for selectively interrupting the detonation wave between a blasting cap and a detonator cord.

Yet another feature of the present invention is to provide a system capable of repeated arming and disarming of an oil well shaped charge perforating device.

These and other features and advantages of the present invention can be understood from the following description of the techniques of producing the invention described in conjunction with the following drawings.

DETAILED DESCRIPTION OF A PREFERRED EMBODIMENT

Figure 1:
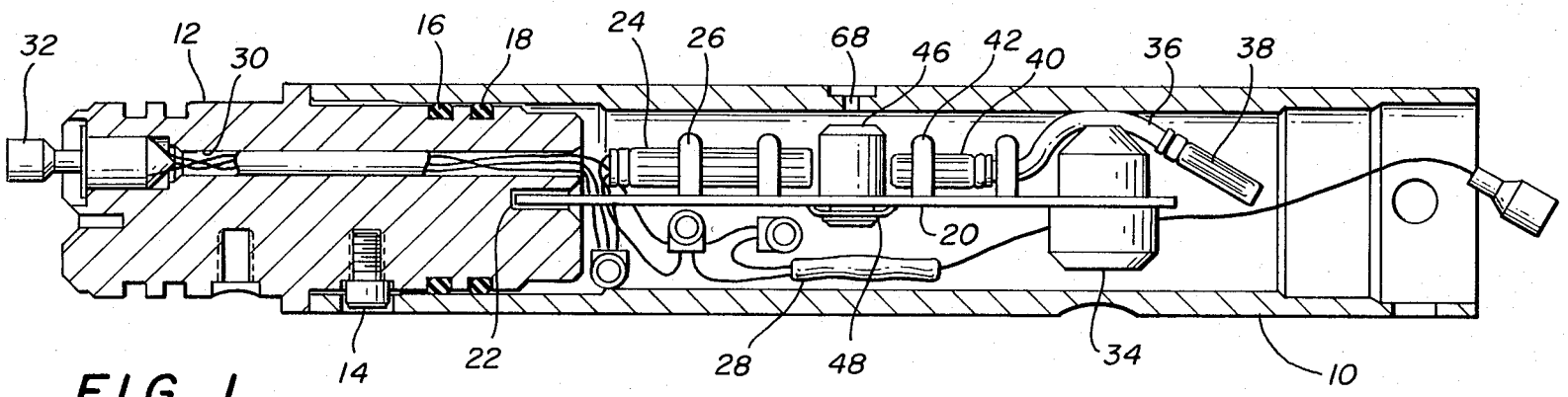
FIG. 1 is a schematic representation of one section of a jet perforating device employing the present safe/arm system.

Referring now to the drawings in more detail, particularly to FIG. 1, there is illustrated one section of a jet perforating gun. It should be recognized that a complete perforating gun is comprised of a number of shaped charge sections as illustrated in FIG. 1. In a typical perforation operation the complete gun assembly will be comprised of from ten to thirty of such sections mechanically coupled together.

As illustrated in FIG. 1, each gun section will include a gun body housing section 10 and a connector sub 12. Connector sub 12 is sized to allow for insertion of a portion thereof into housing 10. Connector sub 12 and housing 10 are fixed together by a suitable manner, such as threaded cap screw 14. O-rings 16 and 18 provide a fluid occlusive seal preventing well bore fluids from entering the gun body 10. Connector sub 12 allows for gun body housing sections to be coupled together to form a complete gun assembly as previously discussed.

Mounted to connector sub 12 is carrier strip 20. The embodiment illustrated is for a perforating gun having 1 11/16 inches outside diameter and having gun sections of 11.6 inches in length. This embodiment uses a carrier strip 20 constructed of 14 gauge steel having a thickness of 0.0747 inches, a width of 1.14 inches, and 9 inches in length. Carrier strip 20 has one end fitted into a transverse slot 22 located on connector sub 12 and can be restrained in place by any suitable manner such as screws or pins. An electrically detonatable blasting cap 24 is mounted to carrier strip 20 by retainer cap 26. In the preferred embodiment blasting cap 24 is a series number E-125 cap, manufactured by DuPont Corporation. The electrical leads from blasting cap 24 attach to electrical conductors traversing longitudinal passage 30 in connector sub 12. These electrical conductors are connected at activator switch 32 and polarity selector 28. Polarity selector 28 can be selected to activate on either of positive or negative voltage signal. By alternating the polarity of polarity selector 28 between gun sections there is provided an ability to fire gun sections sequentially by selection of the polarity of the firing signal.

Proximate the distal end of carrier strip 20 is mounted shaped charge 34. Shaped charge 34 can be of any number of various designs or styles commonly used in the industry. Located at the dorsal portion of shaped charge 34 is detonator cord 36. Detonator cord 36 is preferably, but not limited to, the type known commercially as R.D.X. cored, plastic covered Primacord. End seals 38 and 40 are crimp connected to each end of detonator cord 36 and end seal 40 and one end of detonator cord 36 are mounted to carrier strip 20 by retainer clip 42.

Rotatably attached to carrier strip 20 in a position intermediate blasting cap 24 and end seal 40 is safing assembly 46. Safing assembly 46 is held in position on carrier strip 20 by retainer ring 48 which can be a bowed Truarc ring. Bowed retainer ring 48 provides a frictional lack preventing accidental rotation of the safing assembly 46 due to vibration.

Figure 2:
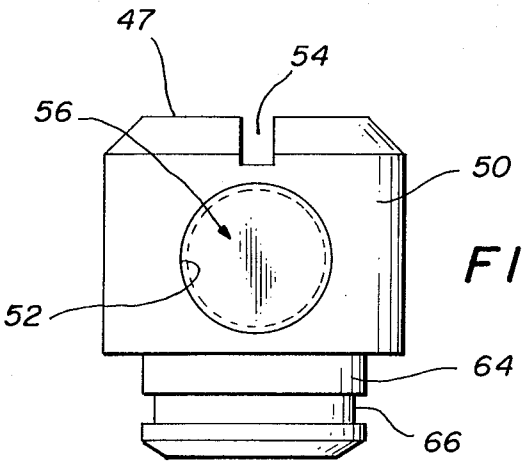
FIG. 2 is a more detailed representation of a portion of the safing system of FIG. 1.

A more detailed view of safing assembly 46 is shown in FIG. 2. Safing assembly 46 is comprised of a body member 47 having a generally circular portion 50 with a transversely oriented bore 52 therethrough. In the preferred embodiment illustrated section 50 of body member 47 is approximately 0.40 inches in height with a diameter of 0.50 inches with transverse bore 52 having a diameter of 0.257 inches. Slot 54 is oriented transversely across body member 48 in parallel with bore 52. Explosive element 56 is installed within bore 52.

Figure 3:
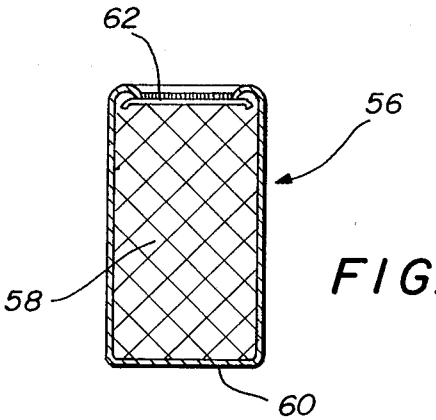
FIG. 3 is a detailed representation of the explosive element portion of the safing system.

Referring now to FIG. 3, there is illustrated explosive element 56 in greater detail. Explosive element 56 includes approximately 0.4 grams of explosive material 58, preferably such H.N.S., as having a density of approximately 1.62 gm/cc. Explosive material 58 is enclosed within housing 60 which is an aluminum can having an outside diameter of 0.250 inches with a 0.010 inch wall thickness and between 0.430 and 0.450 inches in overall height. Aluminum disc 62, which is approximately 0.21 inches in diameter and 0.010 inches in thickness, is held in place over one end of explosive material 58 by a 360′ roll crimp of the open end portion of housing 60.

Returning now to FIGS. 1 and 2, body member 47 of the safing assembly 46 has a generally reduced diameter portion 64 with a groove 66 about the circumference. This reduced diameter portion extends through an aperture in carrier strip 20 and is retained there by retainer ring 48. In the operation of a typical shaped charge section as illustrated, an electrical signal is supplied from a surface location to activator switch 32 by means of an electrical conductor comprising an electrical wireline (not illustrated). Activator switch 32 will pass the firing signal to blasting cap 24. In the armed position, as illustrated by the position of safing assembly 46, body member 48 is rotated to place bore 52 in line with the axis of propogation of the detonator wave from blasting cap 24 to detonator cord end seal 40. The electrical signal to blasting cap 24 causes a detonation wave to propogate from blasting cap 24 onto explosive element 56 causing detonation of explosive element 56 further transferring the detonating wave onto detonator cord 36 through end cap 40. Detonation of detonator cord 36 in turn detonates shaped charge 34 resulting in the formation of a "jet". A more detailed description of the detonation process of shaped charge 34 is formed in U.S. Pat. No. 4,387,773 which is incorporated herein by reference.

As previously discussed, of primary concern is a danger that blasting cap 24 will be unintentionally ignited while in storage or shipment thereby causing the undesired detonation of shaped charge 34. The present invention provides a system for preventing such spurious detonation of shaped charges by isolating blasting cap 24 from detonator cord 36 while allowing for arming and resafing of the perforator. To prevent the unintentional detonation of shaped charge 34 safing assembly 46 is rotated so that bore 52 and thus explosive element 56 is perpendicular to the axis of propogation of the detonation wave from blasting cap 24 to detonator cord end seal 40. Safing assembly 46 can be repeatedly rotated between the safe and armed positions by means of a suitable instrument through aperture 68 in gun body housing and sized to fit within slot 54. The position of the instrument is a visual indication of the statues of the safing system, i.e. whether in a safed or armed position.

In normal operation, the safing assembly 46 is rotated to place bore 52 perpendicular to the axis of the detonating wave from blasting cap 24 to detonator cord 36. When it is desired to arm the perforating gun section, safing assembly 46 is rotated to the illustrated position placing explosive element 56 in the line of propogation of the detonation wave. Once the gun is armed, aperture 68 is plugged and made fluid tight by insertion of a threaded screw. Should it be required to re-safe the perforating gun, the screw can be removed and safing assembly 68 rotated to the safe position.

Many modifications and variations besides those specifically mentioned may be made in the techniques and structures described herein and depicted in the accompanying drawing without departing substantially from the concept of the present invention. Accordingly it should be clearly understood that the form of the invention described and illustrated herein is exemplary only and is not intended as a limitation on the scope of the present invention.

The embodiments of the invention in which an exclusive property or privilege is claimed are defined as follows:

1. A perforating apparatus for use in completing a subsurface well, comprising:

an elongated tubular housing member;

an elongated carrier strip retained within said housing member;

at least one shaped charge unit mounted on said carrier strip, said shaped charge having the axis of perforation directed generally laterally from said carrier strip;

a length of detonator cord having one end thereof mounted on said carrier strip and a portion thereof proximate the dorsal portion of said shaped charge;

an electrical blasting ccap mounted on said carrier strip; and means rotatably mounted on said carrier strip intermediate said blasting cap and said one end of said detonator cord for selectively blocking an explosive detonation wave from said blasting cap to said one end of said detonator cord when rotated to a first position and passing said explosive detonation wave when rotated to a second position.

2. A perforating apparatus for use in completing a subsurface well, comprising:

an elongated tubular housing member;

an elongated carrier strip retained within said housing member;

at least one shaped charge unit mounted on said carrier strip, said shaped charge having the axis of perforation directed generally laterally from said carrier strip;

a length of detonator cord having one end thereof mounted on said carrier strip and a portion thereof proximate the dorsal portion of said shaped charge;

an electrical blasting cap mounted on said carrier strip; and means rotatably mounted on said carrier strip intermediate said blasting cap and said one end of said detonator cord for selectively blocking an explosive detonation wave from said blasting cap to said one end of said detonator cord, said explosive detonation wave blocking means further comprises:

a body member having a transversely oriented bore therethrough; and an explosive element retained within said bore.

3. The perforating apparatus of claim 2 wherein said explosive element comprises:

a housing member; and a quantity of explosive material contained within said housing member.

4. The perforating apparatus of claim 3 wherein said explosive material comprises, H.N.S. explosive.

5. The perforating apparatus of claim 4 wherein said quantity of explosive material comprises approximately 0.4 grams.

6. A perforating apparatus for use in perforating subsurface earth formations, comprising:

an elongated tubular housing member having an aperture in the side thereof;

a length of mounting member within said housing member;

a shaped charge unit extending through said mounting member having the axis of perforation directed laterally from said mounting member;

a section of detonator cord, said detonator cord having a portion thereof proximate the dorsal portion of said shaped charge and one end thereof mounted to said mounting member;

an electrical detonator mounted to said mounting member and axially aligned with said one end of said detonator cord; and a rotatably safe/arm member mounted on said mounting member and generally alligned with said aperture in said tubular housing member;

said safe/arm member having a transversely oriented bore therethrough, said bore being selectively axially alignable with said detonator and said one end of said detonator cord in an armed position.

7. The perforating apparatus of claim 6 further comprising an explosive element retained within said bore.

8. The perforating apparatus of claim 7 wherein said explosive element further comprises:

a housing member; and a quantity of explosive material within said housing member.

9. The perforating apparatus of claim 8 wherein said housing member comprises:

a metallic can; and a disc end-seal for retaining said quantity of explosive material within said can.

10. The perforating apparatus of claim 9 wherein said quantity of explosive material comprises approximately 0.4 grams of H.N.S. explosive.

11. The perforating apparatus of claim 10 further comprising means for frictionally mounting said safe/-arm member on said mounting member.

* * * * *